US006702120B1

(12) United States Patent
Forslund et al.

(10) Patent No.: US 6,702,120 B1
(45) Date of Patent: Mar. 9, 2004

(54) SCREENING APPARATUS INCLUDING TWO SCREEN MEANS

(75) Inventors: Kjell Forslund, Sundsbruk (SE); Björn Wikström, Valbo (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/937,049

(22) PCT Filed: Mar. 3, 2000

(86) PCT No.: PCT/SE00/00421

§ 371 (c)(1),
(2), (4) Date: Sep. 20, 2001

(87) PCT Pub. No.: WO00/58549

PCT Pub. Date: Oct. 5, 2000

(30) Foreign Application Priority Data

Mar. 29, 1999 (SE) ..... 9901148

(51) Int. Cl.[7] ..... B07B 1/24; B07B 1/26; B07B 1/20

(52) U.S. Cl. ..... 209/270; 209/303; 209/304; 209/283

(58) Field of Search ..... 209/270, 273, 209/281, 283, 303, 304, 305, 306; 210/413, 414, 415

(56) References Cited

U.S. PATENT DOCUMENTS

| | | | | |
|---|---|---|---|---|
| 3,713,536 | A | 1/1973 | Hooper | 209/273 |
| 3,713,595 | A | 1/1973 | Craig et al. | 241/46.11 |
| 3,785,495 | A | 1/1974 | Holz | 210/210 |
| 3,933,649 | A * | 1/1976 | Ahlfors | 209/270 X |
| 3,939,065 | A | 2/1976 | Ahlfors | 209/240 |
| 4,066,547 | A | 1/1978 | Hoks | 210/78 |
| 4,642,189 | A | 2/1987 | Hooper | 210/405 |
| 4,699,324 | A | 10/1987 | Ahs | 241/21 |
| 4,744,894 | A | 5/1988 | Gauld | 209/234 |
| 4,749,474 | A | 6/1988 | Young | 209/273 |
| 4,851,111 | A | 7/1989 | Martin et al. | 209/304 |
| 4,911,828 | A | 3/1990 | Musselmann et al. | 209/273 |
| 5,096,127 | A | 3/1992 | Young | 241/46.17 |
| 5,096,627 | A | 3/1992 | Vogelgesang et al. | 264/1.9 |
| 5,318,186 | A | 6/1994 | Rienecker | 209/273 |
| 5,622,267 | A * | 4/1997 | Hautala | 209/273 |
| 5,925,249 | A | 7/1999 | Fredriksson | 241/46.17 |
| 6,029,821 | A * | 2/2000 | Einoder | 210/415 X |
| 6,170,769 | B1 | 1/2001 | Bergdahl et al. | 241/46.17 |
| 6,613,191 | B2 * | 9/2003 | Rienecker et al. | 162/55 |
| 2002/0139723 | A1 * | 10/2002 | Danger et al. | 209/273 |

FOREIGN PATENT DOCUMENTS

| | | |
|---|---|---|
| EP | 649940 | 7/1998 |
| GB | 2319196 | 5/1998 |
| SE | 308 445 | 2/1969 |
| SE | 507 905 | 4/1997 |
| WO | 93/23609 | 11/1993 |
| WO | 95/06159 | 3/1995 |
| WO | 95/11336 | 4/1995 |
| WO | 96/02700 | 2/1996 |
| WO | 97/13918 | 4/1997 |
| WO | 98/46821 | 10/1998 |
| WO | 99/45193 | 9/1999 |

* cited by examiner

*Primary Examiner*—Donald P. Walsh
*Assistant Examiner*—Daniel K Schlak
(74) *Attorney, Agent, or Firm*—Lerner, David, Littenberg, Krumholz & Mentlik, LLP

(57) ABSTRACT

Apparatus for separating a fiber suspension is provided including a housing with an upper chamber in the upper portion thereof, a rotor rotatably mounted in the housing, a first rotary screen mounted for rotation with the rotor and dividing the housing into a first screen chamber and a first accept chamber, a second screen radially outward from the rotor defining a second screen chamber, the diameter of the first rotary screen being less than that of the second screen, the first rotary screen being located within the second screen, an inlet, a reject outlet, at least one accept outlet and a stator within the first rotary screen including at least one pulse member for creating a pulse within the first rotary screen, the diameter of the housing being less than the diameter of the second screen and the first rotary screen being separated from the second screen chamber and located at least partially within the second screen chamber.

9 Claims, 2 Drawing Sheets

SCREENING APPARATUS INCLUDING TWO SCREEN MEANS

This invention relates to a pressurized screening apparatus for separating fiber suspension, preferably pulp suspension. The screening apparatus comprises a screen housing with an upper chamber highest up in the screen housing, a rotor means, which is rotary about a rotor shaft, and at least two coaxially arranged screen means. A first tubular screen means divides the interior of the screen housing in radial direction into a first screen chamber located outside the first screen means with an outer defining surface, and a first accept chamber located inside the first screen means. A second tubular screen means divides the interior of the screen housing, so that a second screen chamber is formed between the second screen means and an inner defining surface. The first screen means has a smaller diameter than the second screen means and at least partially is located inside the second screen means. The screening apparatus further comprises an inlet means for fiber suspension to the screening apparatus, at least one reject outlet for reject from the screening apparatus, and at least one accept outlet means for accept from the screening apparatus.

Such a screening apparatus with several screen means (screening steps) in the same screen housing is called combi-screen. A combi-screen of the aforesaid type is used, for example, at multistep screening of pulp suspensions, preferably for fractionating or separating impurities and other foreign matter undesired in the final product, such as shives, coarse particles, scrap, stones or incompletely digested or not refined chip bits.

One example of a screening apparatus of the above described type and showing known state of art is set forth in PCT application WO95/06159. The first screen means as well as the second one are stationary. The second screen means divides the interior of the screen housing into a second screen chamber located inside the second screen means, and a second accept chamber located outside the second screen means. The pulp suspension to be screened is introduced via the inlet means to the first screen chamber, where the approved fraction, the accept, flows through the first screen means and into the first accept chamber. In the first screen chamber and near the first screen means, pulse elements, so-called wings, are provided on the rotor means, upon rotation of the rotor means, pulses are created by the wings which assist in guiding the accept through the first screen means and into the first accept chamber. The accept flows up through the first accept chamber and further up through and inside the rotor means to the second screen chamber. In the second screen chamber, as in the first one, wings are located on the rotor in order to create pulses at the second screen means. The accept from the second screen chamber flows through the second screen means and out into the second accept chamber to be discharged via the accept outlet, which is located in the second accept chamber.

The second screen chamber communicates, and partially coincides, with the first screen chamber, so that the pulp suspension (the reject), which does not pass the second screen means, flows down to the first screen chamber. There the reject from the second screen chamber again can pass through the first screen means or flow out through the reject outlet means, which is located in the first screen chamber.

Another combi-screen is shown in PCT application WO96/02700 where a coarse screen is combined with two more screen steps. All screen means are here thought to be located above each other.

Combi-screens have been developed in order to bring about a cheaper screening apparatus than is the case if every screen step is arranged in separate screening apparatuses. Combi-screens, however, tend to be relatively high, because the screen means are combined one above the other. Combi-screens can imply compromises, which in most cases result in poorer screen results and high energy consumption.

The present invention has the object to offer a solution of the aforesaid problems and to indicate a compact combi-screen, which yields good screen results and low energy consumption. The outer defining surface of the first screen is given a greatest diameter which is smaller than the smallest diameter of the inner defining surface of the second screen chamber. The first screen chamber at least partially is located inside the second screen chamber, and the first screen chamber is separated from the second screen chamber. The inner defining surface of the second screen chamber constitutes the inner defining surface of the second screen step. This implies that the first screen step inclusive of the screen means with the chambers outside and inside thereof are located at least partially inside the second screen step. The screening apparatus thereby can be constructed low and becomes lower the greater portion of the first screen step is located inside the second screen step.

In order to achieve a good screen result, it is important that the first screen step yields a uniform pulp quality for subsequent screen steps. In a screening apparatus of the said kind, instead of the first stationary screen means, according to known state of art, a first rotary screen means is provided. Instead of the rotating wings a stator is provided inside the rotary screen means, and on the stator at least one pulse means is located. The first screen means is placed on the rotor means to rotate with the same. Suitably at least one of the pulse means shall be a barrier/pulse element. The barrier/pulse element extends in axial direction substantially along the entire stator and the entire first screen means. Upon rotation of the first screen means the barrier/pulse element creates both suction pulses to guide the accept into the first accept chamber and pressure pulses to clean the first screen means and to prevent thickening and plugging in the first screen chamber.

The rotary screen means is given a considerably smaller diameter relative to the second screen means. Hereby the circumferential speed at screening at the rotary screen means becomes considerably lower than at the second screen means. The energy demand thereby is lower than in the case of an unnecessary high circumferential speed at the screen surface. When the circumferential speed at the screen surface is greater than demanded for the screening, for example, shives and impurities can be worked so that they are disintegrated and, thus, can pass through the screen means. The considerably smaller diameter is a great advantage when the first screen step is a coarse screen step. There one needs to have, and preferably would like to have, a considerably lower circumferential speed at the screen surface than is needed at fine screening.

The characterizing features of the invention are apparent from the attached claims.

A preferred embodiment will be described in the following, with reference to the accompanying drawings, where FIG. 1 shows a screening, apparatus according to the invention, FIG. 2 is a cross-section of the screening apparatus in FIG. 1, FIG. 3 shows a preferred design of the barrier/pulse elements.

The screening apparatus in FIG. 1 comprises a pressurized screen housing 1 with an upper portion 2 and a lower portion 3. In the screen housing 1 a rotor means 4 is located which is rotary about a rotor shaft 5. On the rotor means 4 and partially in the lower portion 3 of the screen housing 1 a first tubular screen means 6 is located which is rotary.

The rotary screen means 6 divides the interior of the screen housing 1 into a first screen chamber 7 outside the rotary screen means 6 and a first accept chamber 9 inside the same. The first screen chamber 7 has an outer defining surface 8 where the outer defining surface 8 partially coincides with the lower portion 3 of the screen housing 1. In order to achieve strong centrifugal forces to assist at the separation of heavy particles from the pulp suspension, the first screen chamber 7 should not be too great. The first accept chamber is defined inward by a stator 17 located inside the rotary screen means 6 and having at least one pulse means 18. The rotary screen means 6 and the stator 17 are arranged co-axially. The pulse means 18 are arranged upon rotation of the rotary screen means 6 to create suction pulses. The suction pulses assist in guiding the approved fraction, the accept, of the fiber suspension to be separated, from the first screen chamber 7 into the first accept chamber 9. The fiber suspension in this example is a pulp suspension.

The rotary screen means 6 with the first screen chamber 7, the first accept chamber 9 and stator 17 constitute a first screen step.

In the upper portion 2 of the screen housing 1 a second tubular screen means 10 is located which is stationary. The stationary screen means 10 divides the interior of the screen housing 1 in such a way, that inside the stationary screen means 10 a second screen chamber 11, and outside the stationary screen means 10 a second accept chamber 12 are formed. The second screen chamber 11 is defined inward by an inner defining surface 23, which at this embodiment coincides with the surface of the rotor means 4 in the second screen chamber 11.

In the second screen chamber 11 near the stationary screen in means 10 pulse elements 13 are located on the rotor means 4. The pulse elements 13 can be one or several and are arranged upon rotation of the rotor means 4 to create pulses. The pulses assist the accepted fraction from the second screen chamber 11 to pass through the stationary screen means 10 and out into the second accept chamber 12.

The stationary screen means 10, the second screen chamber 11, the second accept chamber 12 and pulse elements 13 constitute a second screen step.

The first screen step at the embodiment shown is located lowermost of the screen steps, which at the embodiment shown are two in number.

The screen means can be of any type of screen means, with screen openings of a suitable size for passing through the desired portion of the pulp suspension. The screen means, for example, can have slits with openings between 0.1 mm and 0.5 mm, or holes with hole diameter between 0.1 mm and 12 mm.

The greatest diameter of the outer defining surface 8 of the first screen chamber 7 is smaller than the greatest diameter of the inner defining surface 23 of the second screen chamber 11. This implies that the first screen chamber 7 partially can be placed inside the second screen chamber 11. At the embodiment shown, the inner defining surface 23 of the second screen chamber 11 has conical shape, and the outer defining surface 8 of the first screen chamber 7 has cylindric shape. They can, of course, also have other shapes.

Also the first screen chamber 7, for example, can have conical shape. The shape and diameter of the outer defining surface 8 and, respectively, the inner defining surface 23 decide the size of the portion of the first screen chamber 7 which can be located inside the second screen chamber 11.

The first screen step, thus, at least partially is located inside the second screen step and, thus, the rotary screen means 6 at least partially is located inside the stationary screen means 10. The rotary screen means 6 has a considerably smaller diameter than the stationary screen means 10. Already a diameter, which is 25% smaller than the diameter of the stationary screen means 10, yields reduced energy consumption. The diameter of the rotary screen means 6, however, suitably is at least 35% and preferably up to 50% smaller than the diameter of the stationary screen means 10. In order to render it possible for the first screen step to have a capacity as high as that of subsequent screen steps, the first screen step can be made relatively high without changing the total height of the screening apparatus. This is due to the fact that only the portion of the first screen step which is located inside subsequent screen steps is made higher. In this way a functioning screen apparatus can be obtained without increasing its height too much.

An additional way to bring about higher capacity in the first screen step is to give the rotary screen means 6 a conical shape. The diameter of the rotary screen means 6 should thereby increase in the direction of the flow of the accept in the first accept chamber 9, i.e., upwardly in the embodiment shown in the drawings. An example of a conical rotary screen means 28 is shown in phantom lines in FIG. 1. In this manner, with the same height as at a cylindrical rotary screen means 6 a greater screen surface is obtained.

An inlet means 14 is provided for the supply of pulp suspension to the first screen chamber 7. The inlet means 14 suitably is located so that the pulp suspension is supplied as far upwardly as possible in the first screen chamber. This, however, is not necessary, because the first screen chamber 7 is pressurized and, thus, the pulp suspension is distributed in the first screen chamber 7 even if the pulp suspension is supplied farther down in the first screen chamber 7.

The portion of the fiber suspension in the first screen chamber 7 which cannot pass through the rotating screen means 6 is removed via a first reject outlet 15 connected to the first screen chamber 7.

The pulp suspension which has flown through the rotary screen means 6, flows as accept up through the first accept chamber 9 and out through an outlet in the upper portion. Thereafter the pulp suspension flows within the rotor means 4 and out above the same, in order then to flow down in the second screen chamber 11. The reject from the second screen chamber 11 is removed via a second reject outlet means 20, and the portion of the pulp suspension which passes the stationary screen means 10 and into the second accept chamber 12 is removed as accept from the screening apparatus via the accept outlet means 16.

Farthest upwardly in the screen housing 1 an upper chamber 22 is located. In this chamber 22 light reject is collected, i.a. the reject which is lighter than the pulp suspension in general. The light reject consists most often of plastics. In the top portion of the screen housing suitably a light reject separation means 21 is provided which, for example, can be of the type described in the Swedish patent 504 162. The light reject, thus, can be removed before the pulp suspension arrives at the second screen step.

The space 24 is a pressurized dilution chamber. Through a dilution liquid inlet means 25 dilution liquid is supplied to the dilution chamber 24. Farthest upwardly in the wall of the dilution chamber 24 adjacent the second screen chamber 11 a gap 26 is made. The dilution chamber 24 is subjected to overpressure relative to the second screen chamber 11. Thereby dilution liquid flows through the gap 26 and out in the second screen chamber 11. In the same way dilution liquid can be supplied to the first screen chamber 7.

At least one of the pulse means 18 should be a barrier/pulse clement 19. At the embodiment shown, four barrier/pulse elements 19 are located on the stator 17. The barrier/pulse elements 19 can be one or several in number, but suitably 2–8 and most suitably 3–4, and advantageously symmetrically, are located in the circumferential direction of the stator 17.

The barrier/pulse elements 19 extend in axial direction along the entire stator 17 and are tightly abutting the stator 17. They extend from the stator 17 out to and along the entire rotary screen means 6. The distance between the barrier/pulse element 19 and rotary screen means 6 shall be so short that accept substantially does not pass between these. A suitable shortest distance between the barrier/pulse element 19 and rotary screen means 6 is 4 to 10 mm. The first accept chamber 9 thereby is divided into a number of small accept cells $\mathbf{9}_1$, $\mathbf{9}_2$, $\mathbf{9}_3$ and $\mathbf{9}_4$.

At the embodiment shown, the barrier/pulse elements 19 extend in axial direction straight down from above. In order to assist in feeding the accept in the accept cells $\mathbf{9}_1$, $\mathbf{9}_2$, $\mathbf{9}_3$, $\mathbf{9}_4$ and out of the first accept chamber 9, the barrier/pulse elements 19 can, instead, be designed so that they, seen axially in the direction to the accept outlet from the first accept chamber 9 (at this embodiment upward from below), deflect in the rotation direction of the rotary screen means 6. This implies that the accept more easily can be moved out of the first accept chamber 9, and thereby a lower pressure drop above the stator 17 is obtained.

Upon rotation of the rotary screen means 6, a suction pulse is created on the rear side of the barrier/pulse element 19, seen in the rotation direction. The approved fraction, the accept, of the pulp suspension flows thereby through the rotary screen means 6 and into one of the accept cells $\mathbf{9}_1$, $\mathbf{9}_2$, $\mathbf{9}_3$ or $\mathbf{9}_4$. The main portion of the accept flows thereafter up through the first accept chamber 9 and through the screening apparatus.

During the rotation of the rotary screen means 6 the accept in the accept cells $\mathbf{9}_1$, $\mathbf{9}_2$, $\mathbf{9}_3$ and $\mathbf{9}_4$ partially follows along in the rotation of the rotary screen means 6. When the accept thereby approaches the barrier/pulse element 19, portions of the accept are pressed back through the rotary screen means 6 and out into the first screen chamber 7. Thereby the rotary screen means 6 is cleaned of possible cloggings, and the pulp suspension in the first screen chamber 7 is mixed with the accept fraction from the first accept chamber 9. This prevents too much thickening of the pulp suspension in the first screen chamber 7. At the same time also co-rotation of the accept in the first accept chamber 9 is prevented. The risk of plugging in the first screen chamber 9 is reduced, and at the same time a reduced energy consumption is obtained.

In order to cause the barrier/pulse element 19 upon rotation of the rotating screen means 6 to create strong pressure pulses to the pulp suspension in the first screen chamber 7, a suitable design of the barrier/pulse element 19 is the one shown in FIG. 3. Facing toward the rotary screen means 6, the barrier/pulse element 19 has a pulse surface 27 where the distance between the pulse surface 27 and rotary screen means 6 decreases in the rotation direction of the rotary screen means 6 to the point where the barrier/pulse element 19 is closest to the rotary screen means 6. When the accept approaches the barrier/pulse element 19, it is forced by the shape of the barrier/pulse element 19 out through the rotary screen means 6 and out into the first screen chamber 7.

The barrier/pulse element 19, instead of being attached to the stator 17, can be formed as one unit with the same.

The barrier/pulse element 19, of course, can have another shape than the one shown. Different designs of the pulse surface 27 yield pulses of different strength.

The portion of the barrier/pulse element 19 which is faced against the rotation direction of the rotary screen means 6 should be designed so that it assists in guiding the accept out to the rotary screen means 6. This surface, thus, seen from the inside of the stator 17 and out to the rotary screen means 6, should be radial or deflect in the rotation direction of the rotary screen means 6.

A variant of the stator is that it is provided, in addition to barrier/pulse elements, also with pulse elements of conventional type. It can, for example, be provided with 4 barrier/pulse elements and between them with usual pulse elements, where the accept can pass between the wing and stator.

At the embodiment shown, the stator 17, the rotary screen means 6 and the outer defining surface 8 of the first screen chamber 7 all have the shape of a cylinder. One or several of the stator, the rotary screen means and, respectively, the outer defining surface of the first screen chamber can also, for example, be conical with different or equal angle relations in relation to each other. By forming the outer defining surface of the first screen chamber and, respectively, the stator cylindric or conical, the accessible space between them can be changed. By changing, for example, the rotary screen means from cylindric to conical, the relation between accessible space in the first screen chamber and, respectively, the first accept chamber can be changed. When thereby the accessible space in axial direction becomes different, the space in the first accept chamber should increase in the direction to the accept outlet from the same, and the space in the first screen chamber should be greatest at the inlet, This applies, of course, also to the subsequent screen steps.

Accept outlet means, reject outlet means and inlet means, of course, can be arranged in places in the screening apparatus other than those indicated at the embodiment shown. The number of accept outlet means and reject outlet means and their location depends on the design of the screen apparatus and on the number of screen steps comprised therein.

The second screen step referred to in the description is supposed to be the step which at least partially is located outside the first screen step.

A screening apparatus of the kind stated above, of course, can comprise more than two screen steps arranged with different ways for the pulp suspension to flow within and between the different screen steps. The first screen step can be located uppermost of the screen steps and be followed after by one or more screen steps. When the first screen step is arranged uppermost of the screen steps, it suitably is placed so that the accept leaves the first screen step in the lower portion thereof.

A screening apparatus according to the invention can also, for example, be designed so that from the first screen step the accept flows up to the upper screen step and then down to the second screen step, which partially is located outside the first screen step. Hereby combi-screens with three steps are obtained.

The invention, of course, is not restricted to the embodiment shown, but can be varied within the scope of the claims with reference to the description and Figures.

What is claimed is:

1. Apparatus for separating a fiber suspension comprising a housing having an upper portion and a lower portion including an outer wall, said housing having a predetermined diameter defining an upper chamber in said upper portion of said housing, a rotor rotatably mounted within said housing and including an outer surface, a first rotary screen mounted for rotation with said rotor within said housing and dividing said housing into a first screen chamber between said first rotary screen and said outer wall of said housing and a first accept chamber within said first rotary screen, a second screen disposed radially outward from said outer surface of said rotor and defining a second screen chamber therebetween, said first rotary screen including a first diameter and said second screen including a second diameter, said first diameter being less than said second diameter, said first rotary screen being at least partially located within said second screen, an inlet for providing said fiber suspension to said first screen chamber, at least one reject outlet for withdrawing a reject stream from said housing, at least one accept outlet for withdrawing an accept stream from said first accept chamber, and a stator disposed within said first rotary screen, said stator including at least is one pulse member for creating a pulse within said first rotary screen to assist in driving said accept portion of said fiber suspension through said first rotary screen, said predetermined diameter of said outer wall of said housing being less than said second diameter, and said first rotary screen being separated from said second screen chamber and being located at least partially within said second screen chamber.

2. The apparatus of claim 1 wherein said fiber suspension comprises a pulp suspension.

3. The apparatus of claim 1 wherein said first rotary screen is located axially beneath said second screen.

4. The apparatus of claim 3 wherein said first accept chamber includes a lower portion and an upper portion including an accept chamber exit, whereby said fiber suspension can flow upwardly through said first accept chamber and exit said first accept chamber through said accept chamber exit.

5. The apparatus of claim 4 including a light reject separator disposed at said upper end of said housing for separating a light reject portion of said fiber suspension from said housing.

6. The apparatus of claim 1 wherein said at least one pulse member extends axially along said stator and along said first rotary screen, said at least one pulse member being affixed to said stator and extending radially to a point adjacent to said first rotary screen whereby said accept portion of said fiber suspension is substantially prevented from tangentially passing said at least one pulse member.

7. The apparatus of claim 6 wherein said at least one pulse member includes a pulse surface facing said first rotary screen, said pulse surface having a shape whereby the distance between said pulse surface and said first rotary screen decreases in the direction of rotation of said first rotary screen.

8. The apparatus of claim 1 wherein said stator, said first rotary screen and said outer wall of said housing have a cylindrical shape.

9. The apparatus of claim 1 wherein said first rotary screen has a conical shape.

* * * * *

UNITED STATES PATENT AND TRADEMARK OFFICE

CERTIFICATE OF CORRECTION

PATENT NO. : 6,702,120 B1
DATED : March 9, 2004
INVENTOR(S) : Kjell Forslund and Björn Wikström It is certified that error appears in the above-identified patent and that said Letters Patent is hereby corrected as shown below:

Column 7,
Line 24, delete “is” after “least”.

Signed and Sealed this

Fifteenth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,702,120 B1
APPLICATION NO. : 09/937049
DATED : March 9, 2004
INVENTOR(S) : Forslund et al.

It is certified that error appears in the above-identified patent and that said Letters Patent is hereby corrected as shown below:

Please delete column 1 line 1 *thru* column 8 line 30 and insert columns 1 line 1 *thru* column 10 line 5 as attached

US 6,702,120 B1

1

SCREENING APPARATUS INCLUDING TWO SCREEN MEANS

BACKGROUND OF THE INVENTION

The present invention relates to a pressurized screening apparatus for separating fiber suspension, preferably pulp suspension. More particularly, the present invention relates to screening apparatus comprising a screen housing with an upper chamber highest up in the screen housing, a rotor, which is rotary about a rotor shaft, and at least two coaxially arranged screens. A first tubular screen divides the interior of the screen housing in the radial direction into a first screen chamber located outside the first screen with an outer defining surface, and a first accept chamber located inside the first screen. A second tubular screen divides the interior of the screen housing, so that a second screen chamber is formed between the second screen and an inner defining surface. The first screen has a smaller diameter than the second screen and is at least partially located inside the second screen. The screening apparatus further comprises an inlet for the fiber suspension to the screening apparatus, at least one reject outlet for reject from the screening apparatus, and at least one accept outlet for accept from the screening apparatus.

Screening apparatus such as that discussed above which include several screen means (screening steps) in the same screen housing is called combi-screen. A combi-screen of the aforesaid type is used, for example, during the multistep screening of pulp suspensions, preferably for fractionating or separating impurities and other foreign matter which is undesired in the final product, such as shives, coarse particles, scrap, stones or incompletely digested or unrefined chip bits.

One example of a screening apparatus of the above type in the known state of art is set forth in PCT application WO 95/06159. The first screen means as well as the second one are stationary in this case. The second screen means divides the interior of the screen housing into a second screen chamber located inside the second screen means, and a second accept chamber located outside the second screen means. The pulp suspension to be screened is introduced through the inlet means to the first screen chamber, where the approved fraction, the accept, flows through the first screen means and into the first accept chamber. In the first screen chamber and near the first screen means, pulse elements, or so-called wings, are provided on the rotor means, and upon rotation of the rotor means, pulses are created by the wings which assist in guiding the accept through the first screen means and into the first accept chamber. The accept flows up through the first accept chamber and further up through and inside the rotor means to the second screen chamber. In the second screen chamber, as in the first one, wings are located on the rotor in order to create pulses at the second screen means. The accept from the second screen chamber flows through the second screen means and out into the second accept chamber to be discharged through the accept outlet, which is located in the second accept chamber.

The second screen chamber communicates, and partially coincides, with the first screen chamber, so that the pulp suspension (i.e., the reject), which does not pass the second screen means, flows down to the first screen chamber. There, the reject from the second screen chamber again can pass through the first screen means or flow out through the reject outlet means, which is located in the first screen chamber.

2

Another combi-screen is shown in PCT application WO96/02700 where a coarse screen is combined with two more screen steps. All of the screen means in this case are believed to be located above each other.

Combi-screens have been developed in order to bring about a cheaper screening apparatus than is the case if every screen step is arranged in a separate screening apparatus. Combi-screens, however, tend to be relatively high, because the screen means are combined one above the other. Combi-screens can imply compromises, which in most cases result in poorer screen results and high energy consumption.

One object of the present invention is to offer a solution to the aforesaid problems and to provide a compact combi-screen, which yields good screen results and low energy consumption.

SUMMARY OF THE INVENTION

In accordance with the present invention, this and other objects have now been realized by the invention of apparatus for separating a fiber suspension comprising a housing having an upper portion and a lower portion including an outer wall, the housing having a predetermined diameter defining an upper chamber in the upper portion of the housing, a rotor rotatably mounted within the housing and including an outer surface, a first rotary screen mounted for rotation with the rotor within the housing and dividing the housing into a first screen chamber between the first rotary screen and the outer wall of the housing and a first accept chamber within the first rotary screen, a second screen disposed radially outward from the outer surface of the rotor and defining a second screen chamber therebetween, the first rotary screen including a first diameter and the second screen including a second diameter, the first diameter being less than the second diameter, the first rotary screen being at least partially located within the second screen, an inlet for providing the fiber suspension to the first screen chamber, at least one reject outlet for withdrawing a reject stream from the housing, at least one accept outlet for withdrawing an accept stream from the first accept chamber, and a stator disposed within the first rotary screen, the stator including at least one pulse member for creating a pulse within the first rotary screen to assist in driving the accept portion of the fiber suspension through the first rotary screen, the predetermined diameter of the outer wall of the housing being less than the second diameter, and the first rotary screen being separated from the second screen chamber and being located at least partially within the second screen chamber. Preferably the fiber suspension comprises a pulp suspension.

In accordance with one embodiment of the apparatus of the present invention, the first rotary screen is located axially beneath the second screen. Preferably, the first accept chamber includes a lower portion and an upper portion including an accept chamber exit, whereby the fiber suspension can flow upwardly through the first accept chamber and exit the first accept chamber through the accept chamber exit.

In accordance with another embodiment of the apparatus of the present invention, the at least one pulse member extends axially along the stator and along the first rotary screen, the at least one pulse member being affixed to the stator and extending radially to a point adjacent to the first rotary screen whereby the accept portion of the fiber suspension is substantially prevented from tangentially passing the at least one pulse member. Preferably, the at least one pulse member includes a pulse surface facing the first rotary screen, the pulse surface having a shape whereby the distance between the pulse surface and the first rotary screen decreases in the direction of rotation of the first rotary screen.

UNITED STATES PATENT AND TRADEMARK OFFICE

CERTIFICATE OF CORRECTION

PATENT NO. : 6,702,120 B1
APPLICATION NO. : 09/937049
DATED : March 9, 2004
INVENTOR(S) : Forslund et al.

It is certified that error appears in the above-identified patent and that said Letters Patent is hereby corrected as shown below:

In accordance with another embodiment of the apparatus of the present invention, the stator, the first rotary screen and the outer wall of the housing have a cylindrical shape.

In accordance with another embodiment of the apparatus of the present invention, the first rotary screen has a conical shape. Preferably, the apparatus includes a light reject separator disposed at the upper end of the housing for separating a light reject portion of the fiber suspension from the housing.

In accordance with the present invention, the outer defining surface of the first screen is given a maximum diameter which is smaller than the minimum diameter of the inner defining surface of the second screen chamber. The first screen chamber is at least partially located inside the second screen chamber, and the first screen chamber is separated from the second screen chamber. The inner defining surface of the second screen chamber constitutes the inner defining surface of the second screen step. In this manner, the first screen step inclusive of the screen means with the chambers outside and inside thereof are located at least partially inside the second screen step. The screening apparatus can thus be constructed at a low height, which becomes lower the greater portion of the first screen step which is located inside the second screen step.

In order to achieve an acceptable screen result, it is important that the first screen step yields a uniform pulp quality for subsequent screen steps. In a screening apparatus of this type, instead of the first stationary screen means, as in the known state of art, a first rotary screen means is provided. Instead of the rotating wings, a stator is provided inside the rotary screen means, and on the stator at least one pulse means is provided. The first screen means is placed on the rotor means to rotate therewith. Preferably, at least one of the pulse means shall be a barrier/pulse element. The barrier/pulse element extends in the axial direction substantially along the entire stator and the entire first screen means. Upon rotation of the first screen means the barrier/pulse element creates both suction pulses to guide the accept into the first accept chamber and pressure pulses to clean the first screen means and to prevent thickening and plugging in the first screen chamber.

The rotary screen means is provided with a considerably smaller diameter relative to that of the second screen means. In this manner, the circumferential speed during screening with the rotary screen means becomes considerably lower than that of the second screen means. The energy demand is thus lower than in the case of an unnecessarily high circumferential speed at the screen surface. When the circumferential speed at the screen surface is greater than that demanded for the screening, for example, shives and impurities can be worked so that they are disintegrated, and thus can pass through the screen means. The considerably smaller diameter is a great advantage when the first screen step is a coarse screen step. In this case, one needs to have, and would prefer to have, a considerably lower circumferential speed at the screen surface than is needed during fine screening.

BRIEF DESCRIPTION OF THE DRAWINGS

A preferred embodiment of the present invention will be described in the following detailed description, with reference to the accompanying drawings, in which.

DETAILED DESCRIPTION

Figure 1:
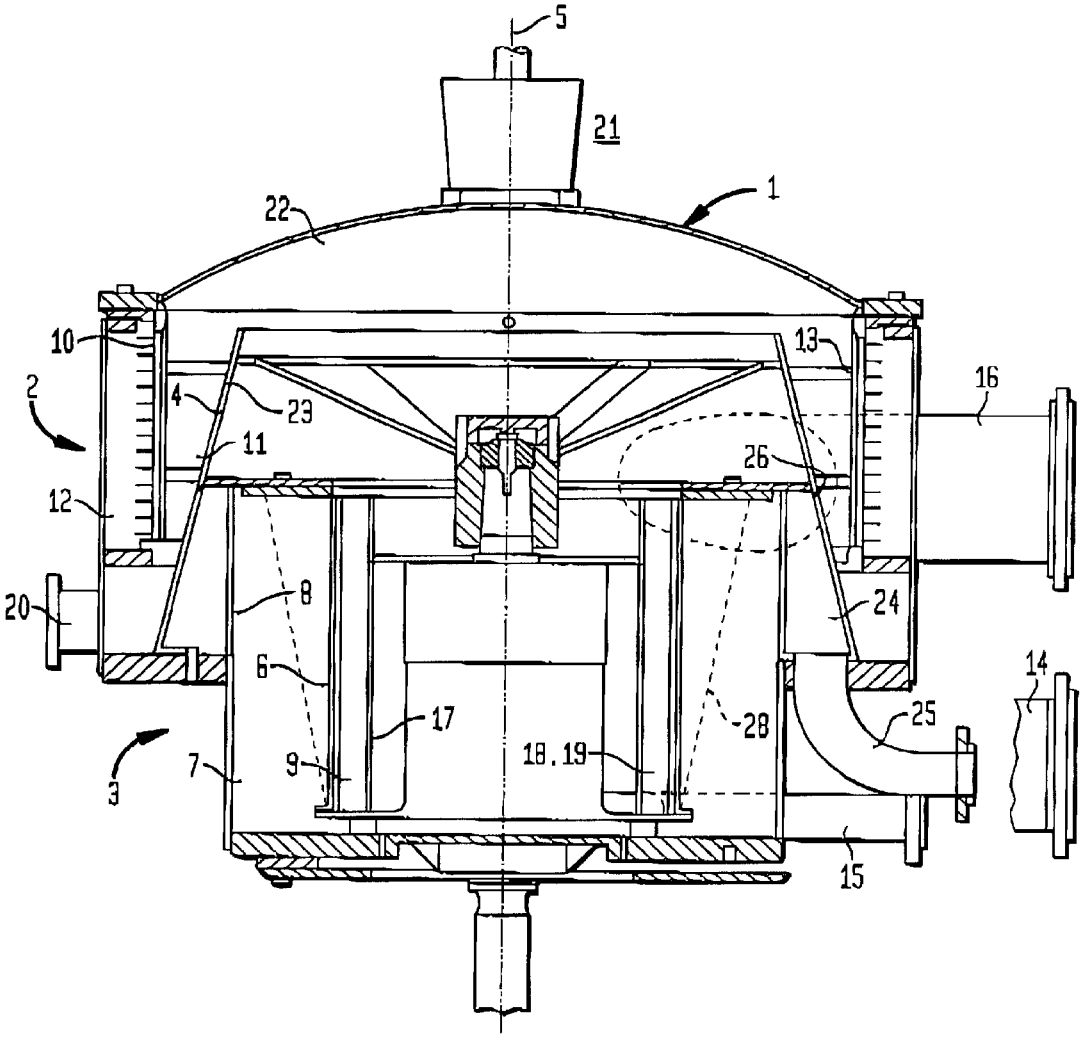
FIG. 1 is a side, elevational, partially sectional view of a screening apparatus according to the present invention.
Figure 2:
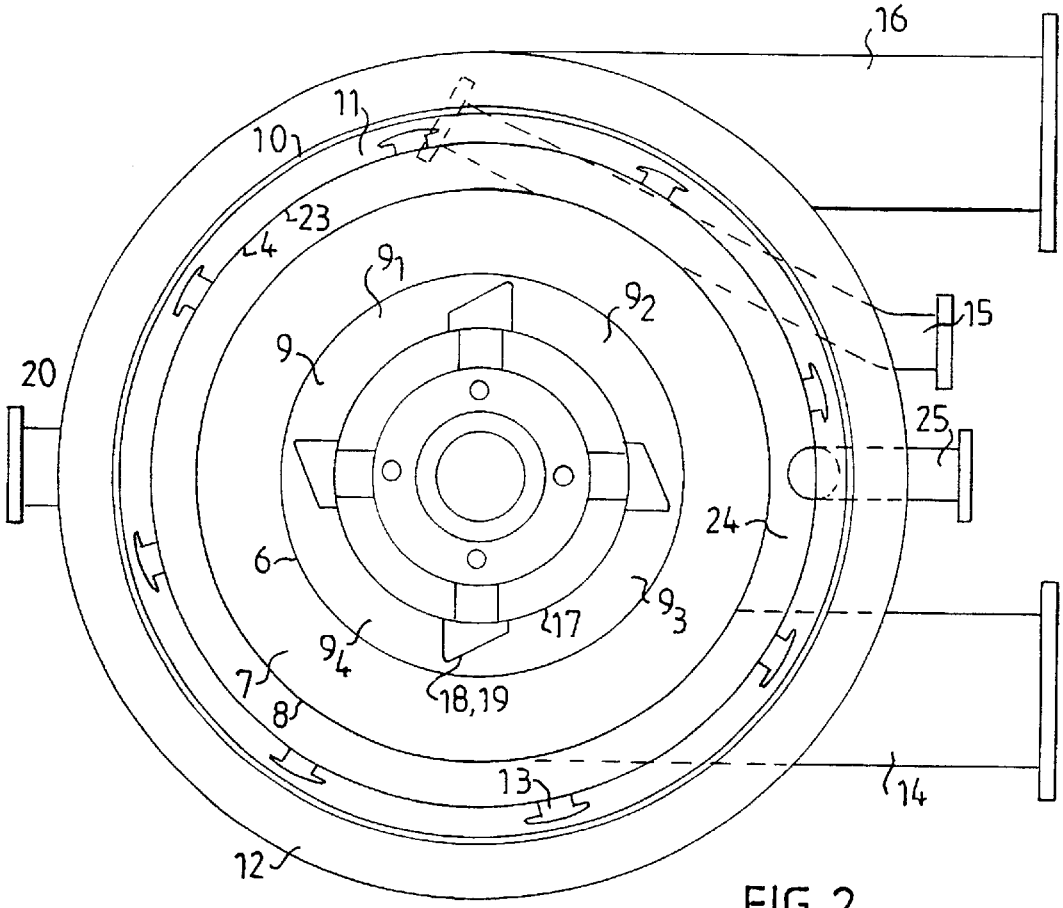
FIG. 2 is a top, elevational, partially sectional view of the screening apparatus shown in FIG. 1.

The screening apparatus in FIG. 1 comprises a pressurized screen housing 1 with an upper portion 2 and a lower portion 3. In the screen housing 1 a rotor means 4 is located which is rotary about a rotor shaft 5. On the rotor means 4 and partially in the lower portion 3 of the screen housing 1, there is located a first tubular screen means 6, which is rotary.

The rotary screen means 6 divides the interior of the screen housing 1 into a first screen chamber 7 outside the rotary screen means 6 and a first accept chamber 9 inside the rotary screen means 6. The first screen chamber 7 has an outer defining surface 8 where the outer defining surface 8 partially coincides with the lower portion 3 of the screen housing 1. In order to achieve strong centrifugal forces to assist in the separation of heavy particles from the pulp suspension, the first screen chamber 7 should not be too large. The first accept chamber is defined inwardly by a stator 17 located inside the rotary screen means 6 and having at least one pulse means 18. The rotary screen means 6 and the stator 17 are arranged co-axially. The pulse means 18 are arranged upon rotation of the rotary screen means 6 to create suction pulses. The suction pulses assist in guiding the approved fraction, the accept, of the fiber suspension to be separated, from the first screen chamber 7 into the first accept chamber 9. The fiber suspension in this example is a pulp suspension.

The rotary screen means 6 with the first screen chamber 7, the first accept chamber 9 and stator 17 constitute a first screen step.

In the upper portion 2 of the screen housing 1 a second tubular screen means 10 is located, which is stationary. The stationary screen means 10 divides the interior of the screen housing 1 in such a way that inside the stationary screen means 10 a second screen chamber 11, and outside the stationary screen means 10 a second accept chamber 12, are formed. The second screen chamber 11 is defined inwardly by an inner defining surface 23, which in this embodiment of the present invention coincides with the surface of the rotor means 4 in the second screen chamber 11.

In the second screen chamber 11 near, the stationary screen means 10, pulse elements 13 are located on the rotor means 4. The pulse elements 13 can be one or more, and are arranged to create pulses upon rotation of the rotor means 4. These pulses assist the accepted fraction from the second screen chamber 11 to pass through the stationary screen means 10 and out into the second accept chamber 12.

The stationary screen means 10, the second screen chamber 11, the second accept chamber 12 and pulse elements 13 constitute a second screen step.

The first screen step in the embodiment shown in the drawings is located lowermost of the screen steps, which in this embodiment are two in number.

The screen means can be of any type of screen means, with screen openings of a suitable size for passing through the desired portion of the pulp suspension. The screen means, for example, can have slits with openings between about 0.1 mm and 0.5 mm, or holes with hole diameter between about 0.1 mm and 12 mm.

The maximum diameter of the outer defining surface 8 of the first screen chamber 7 is smaller than the maximum diameter of the inner defining surface 23 of the second screen chamber 11. This implies that the first screen chamber 7 can be placed partially inside the second screen chamber 11. In the embodiment shown in the drawings, the inner

UNITED STATES PATENT AND TRADEMARK OFFICE

CERTIFICATE OF CORRECTION

PATENT NO. : 6,702,120 B1
APPLICATION NO. : 09/937049
DATED : March 9, 2004
INVENTOR(S) : Forslund et al.

It is certified that error appears in the above-identified patent and that said Letters Patent is hereby corrected as shown below:

defining surface 23 of the second screen chamber 11 has a conical shape, and the outer defining surface 8 of the first screen chamber 7 has a cylindrical shape. They can, of course, also have other shapes.

In addition, the first screen chamber 7, for example, can have conical shape. The shape and diameter of the outer defining surface 8 and the inner defining surface 23, respectively, determine the size of the portion of the first screen chamber 7 which can be located inside the second screen chamber 11.

The first screen step is thus at least partially located inside the second screen step and, thus, the rotary screen means 6 is at least partially located inside the stationary screen means 10. The rotary screen means 6 has a considerably smaller diameter than the stationary screen means 10. Even a diameter which is 25% smaller than the diameter of the stationary screen means 10 yields reduced energy consumption. The diameter of the rotary screen means 6, however, is preferably at least 35%, and more preferably up to 50% smaller than the diameter of the stationary screen means 10. In order to render it possible for the first screen step to have a capacity as high as that of subsequent screen steps, the first screen step can be made relatively high without changing the total height of the screening apparatus. This is due to the fact that only the portion of the first screen step which is located inside subsequent screen steps is made higher. In this manner, a functioning screen apparatus can be obtained without increasing its height to a significant extent.

An additional way to bring about higher capacity in the first screen step is to give the rotary screen means 6 a conical shape. The diameter of the rotary screen means 6 should thereby increase in the direction of the flow of the accept in the first accept chamber 9, i.e., upwardly in the embodiment shown in the drawings. An example of a conical rotary screen means 28 is shown in phantom lines in FIG. 1. In this manner, with the same height as at a cylindrical rotary screen means 6 a greater screen surface is obtained.

An inlet means 14 is provided for the supply of pulp suspension to the first screen chamber 7. The inlet means 14 is preferably located so that the pulp suspension is supplied as far upwardly as possible in the first screen chamber. This, however, is not necessary, because the first screen chamber 7 is pressurized and, thus, the pulp suspension is distributed in the first screen chamber 7 even if the pulp suspension is supplied farther down in the first screen chamber 7.

The portion of the fiber suspension in the first screen chamber 7 which cannot pass through the rotating screen means 6 is removed through a first reject outlet 15 connected to the first screen chamber 7.

The pulp suspension which has flown through the rotary screen means 6, flows as accept up through the first accept chamber 9 and out through an outlet in the upper portion thereof. Thereafter, the pulp suspension flows within the rotor means 4 and out above the rotor means 4, in order then to flow downwardly in the second screen chamber 11. The reject from the second screen chamber 11 is removed through a second reject outlet means 20, and the portion of the pulp suspension which passes the stationary screen means 10 and into the second accept chamber 12 is removed as accept from the screening apparatus through the accept outlet means 16.

Farthest upwardly in the screen housing 1 there is located an upper chamber 22. In this chamber 22 light reject is collected, that is, the reject which is lighter than the pulp suspension in general. The light reject consists most often of plastics. In the top portion of the screen housing a light reject separation means 21 is preferably provided which, for example, can be of the type described in Swedish Patent No. 504,162. The light reject, thus, can be removed before the pulp suspension arrives at the second screen step.

The space 24 is a pressurized dilution chamber. Through a dilution liquid inlet means 25 dilution liquid is supplied to the dilution chamber 24. Farthest upwardly in the wall of the dilution chamber 24 adjacent the second screen chamber 11 a gap 26 is provided. The dilution chamber 24 is subjected to an overpressure relative to the second screen chamber 11. In this manner, dilution liquid flows through the gap 26 and out in the second screen chamber 11. In the same way dilution liquid can be supplied to the first screen chamber 7.

At least one of the pulse means 18 should be a barrier/pulse element 19. In the embodiment shown in the drawings, four barrier/pulse elements 19 are located on the stator 17. The barrier/pulse elements 19 can be one or more in number, but preferably from 2 to 8, and most preferably from 3 to 4, and advantageously they are located symmetrically in the circumferential direction of the stator 17.

The barrier/pulse elements 19 extend in the axial direction along the entire stator 17 and tightly abut the stator 17. They extend from the stator 17 out to and along the entire rotary screen means 6. The distance between the barrier/pulse element 19 and rotary screen means 6 should be sufficiently short such that accept substantially does not pass therebetween. A suitable minimum distance between the barrier/pulse element 19 and rotary screen means 6 is from 4 to 10 mm. The first accept chamber 9 is thus divided into a number of small accept cells, $9_1$, $9_2$, $9_3$ and $9_4$.

In the embodiment shown in the drawings, the barrier/pulse elements 19 extend in the axial direction straight down from above. In order to assist in feeding the accept in the accept cells, $9_1$, $9_2$, $9_3$, and $9_4$, and out of the first accept chamber 9, the barrier/pulse elements 19 can, instead, be designed so that, as seen in the axial direction can accept outlet from the first accept chamber 9 (in this embodiment, upwardly from below), deflect in the direction of rotation of the rotary screen means 6. This implies that the accept can be more readily moved out of the first accept chamber 9, and thus a lower pressure drop is obtained above the stator 17.

Upon rotation of the rotary screen means 6, a suction pulse is created on the rear side of the barrier/pulse element 19, as seen in the direction of rotation. The approved fraction, i.e., the accept, of the pulp suspension thus flows through the rotary screen means 6 and into one of the accept cells, $9_1$, $9_2$, $9_3$ or $9_4$. The main portion of the accept then flows up through the first accept chamber 9 and through the screening apparatus.

During the rotation of the rotary screen means 6 the accept in the accept cells, $9_1$, $9_2$, $9_3$ and $9_4$, partially follows along in the rotation of the rotary screen means 6. When the accept thus approaches the barrier/pulse element 19, portions of the accept are pressed back through the rotary screen means 6 and out into the first screen chamber 7. In this manner, the rotary screen means 6 is cleaned of possible clogging, and the pulp suspension in the first screen chamber 7 is mixed with the accept fraction from the first accept chamber 9. This prevents excessive thickening of the pulp suspension in the first screen chamber 7. At the same time, co-rotation of the accept in the first accept chamber 9 is also prevented. The risk of plugging in the first screen chamber 9 is reduced, and at the same time a reduced energy consumption is obtained.

In order to cause the barrier/pulse element 19, upon rotation of the rotating screen means 6, to create strong pressure pulses in the pulp suspension in the first screen

UNITED STATES PATENT AND TRADEMARK OFFICE

CERTIFICATE OF CORRECTION

PATENT NO. : 6,702,120 B1
APPLICATION NO. : 09/937049
DATED : March 9, 2004
INVENTOR(S) : Forslund et al.

Figure 3:
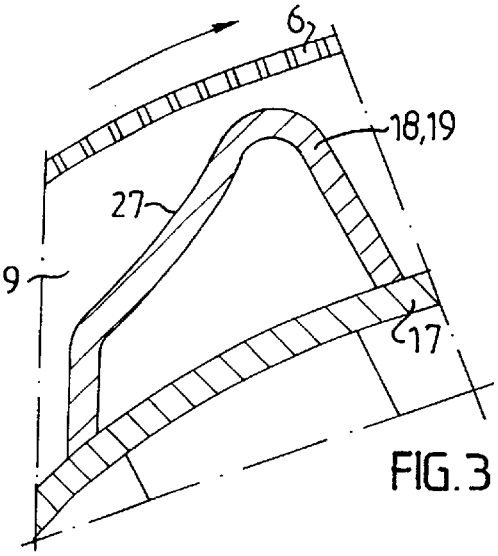
FIG. 3 is a top, elevational, enlarged, sectional view of a preferred design of the barrier/pulse elements used in the present invention.

It is certified that error appears in the above-identified patent and that said Letters Patent is hereby corrected as shown below:

chamber 7, a suitable design of the barrier/pulse element 19 is the one shown in FIG. 3. Facing toward the rotary screen means 6, the barrier/pulse element 19 has a pulse surface 27 in which the distance between the pulse surface 27 and rotary screen means 6 decreases in the direction of rotation of the rotary screen means 6 to the point where the barrier/pulse element 19 is closest to the rotary screen means 6. When the accept approaches the barrier/pulse element 19, it is forced by the shape of the barrier/pulse element 19 out through the rotary screen means 6 and out into the first screen chamber 7.

The barrier/pulse element 19, instead of being attached to the stator 17, can be formed as a single unit therewith.

The barrier/pulse element 19 can have other shapes than the one shown. Different designs of the pulse surface 27 yield pulses of different strength.

The portion of the barrier/pulse element 19 which faces against the direction of rotation of the rotary screen means 6 should be designed so that it assists in guiding the accept out to the rotary screen means 6. This surface, as seen from the inside of the stator 17 and out to the rotary screen means 6, should be radial or deflect in the direction of rotation of the rotary screen means 6.

A variant of the stator is that it is also provided, in addition to barrier/pulse elements, with pulse elements of a conventional type. It can, for example, be provided with 4 barrier/pulse elements and between them with conventional pulse elements, in which the accept can pass between the wing and stator.

In the embodiment shown in the drawings, the stator 17, the rotary screen means 6 and the outer defining surface 8 of the first screen chamber 7 all have the shape of a cylinder. One or more of the stator, the rotary screen means and the outer defining surface of the first screen chamber can also, for example, be conical with different or equal angular relationship with respect to each other. By forming the outer defining surface of the first screen chamber and the stator cylindrical or conical, the accessible space between them can be changed. By changing, for example, the rotary screen means from cylindrical to conical, the relationship between accessible space in the first screen chamber and, respectively, the first accept chamber can be changed. When the accessible space in the axial direction thus becomes different, the space in the first accept chamber should increase in the direction of the accept outlet therefrom, and the space in the first screen chamber should be greatest at the inlet. This also applies to the subsequent screen steps.

Accept outlet means, reject outlet means and inlet means can also be arranged in places in the screening apparatus other than those indicated in the embodiment shown in the drawings. The number of accept outlet means and reject outlet means, and their location, depends on the design of the screen apparatus and on the number of screen steps associated therewith.

The second screen step referred to in the description is intended to be the step which is at least partially located outside the first screen step.

A screening apparatus of the type stated above can comprise more than two screen steps arranged with different means for the pulp suspension to flow within and between the different screen steps. The first screen step can be located uppermost of the screen steps and be followed by one or more screen steps. When the first screen step is arranged uppermost of the screen steps, it is preferably placed so that the accept leaves the first screen step in the lower portion thereof.

A screening apparatus according to the present invention can also, for example, be designed so that from the first screen step the accept flows up to the upper screen step and then down to the second screen step, which is partially located outside the first screen step. In this manner, combi-screens with three steps are obtained.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for separating a fiber suspension comprising a housing having an upper portion and a lower portion including an outer wall, said housing having a predetermined diameter defining an upper chamber in said upper portion of said housing, a rotor rotatably mounted within said housing and including an outer surface, a first rotary screen mounted for rotation with said rotor within said housing and dividing said housing into a first screen chamber between said first rotary screen and said outer wall of said housing and a first accept chamber within said first rotary screen, a second screen disposed radially outward from said outer surface of said rotor and defining a second screen chamber therebetween, said first rotary screen including a first diameter and said second screen including a second diameter, said first diameter being less than said second diameter, said first rotary screen being at least partially located within said second screen, an inlet for providing said fiber suspension to said first screen chamber, at least one reject outlet for withdrawing a reject stream from said housing, at least one accept outlet for withdrawing an accept stream from said first accept chamber, and a stator disposed within said first rotary screen, said stator including at least one pulse member for creating a pulse within said first rotary screen to assist in driving said accept portion of said fiber suspension through said first rotary screen, said predetermined diameter of said outer wall of said housing being less than said second diameter, and said first rotary screen being separated from said second screen chamber and being located at least partially within said second screen chamber.

2. The apparatus of claim 1 wherein said fiber suspension comprises a pulp suspension.

3. The apparatus of claim 1 wherein said first rotary screen is located axially beneath said second screen.

4. The apparatus of claim 3 wherein said first accept chamber includes a lower portion and an upper portion including an accept chamber exit, whereby said fiber suspension can flow upwardly through said first accept chamber and exit said first accept chamber through said accept chamber exit.

5. The apparatus of claim 4 including a light reject separator disposed at said upper end of said housing for separating a light reject portion of said fiber suspension from said housing.

6. The apparatus of claim 1 wherein said at least one pulse member extends axially along said stator and along said first rotary screen, said at least one pulse member being affixed to said stator and extending radially to a point adjacent to said first rotary screen whereby said accept portion of said fiber suspension is substantially prevented from tangentially passing said at least one pulse member.

UNITED STATES PATENT AND TRADEMARK OFFICE

CERTIFICATE OF CORRECTION

PATENT NO. : 6,702,120 B1
APPLICATION NO. : 09/937049
DATED : March 9, 2004
INVENTOR(S) : Forslund et al.

It is certified that error appears in the above-identified patent and that said Letters Patent is hereby corrected as shown below:

US 6,702,120 B1

9

7. The apparatus of claim 6 wherein said at least one pulse member includes a pulse surface facing said first rotary screen, said pulse surface having a shape whereby the distance between said pulse surface and said first rotary screen decreases in the direction of rotation of said first rotary screen.

10

8. The apparatus of claim 1 wherein said stator, said first rotary screen and said outer wall of said housing have a cylindrical shape.

9. The apparatus of claim 1 wherein said first rotary screen has a conical shape.

* * * * *

Signed and Sealed this

Eleventh Day of December, 2007

JON W. DUDAS
*Director of the United States Patent and Trademark Office*